US008007700B2

(12) United States Patent
Perez

(10) Patent No.: US 8,007,700 B2
(45) Date of Patent: Aug. 30, 2011

(54) COAXIAL CABLE OF LOW DIELECTRIC CONSTANT, AND A FABRICATION METHOD AND TOOL THEREFOR

(75) Inventor: Sophie Perez, Marchais en Brie (FR)

(73) Assignee: Axon'Cable, Montmirail (FR)

( * ) Notice: Subject to any disclaimer, the term of this patent is extended or adjusted under 35 U.S.C. 154(b) by 79 days.

(21) Appl. No.: 12/222,090

(22) Filed: Aug. 1, 2008

(65) Prior Publication Data

US 2009/0101381 A1 Apr. 23, 2009

(30) Foreign Application Priority Data

Aug. 2, 2007 (FR) ..... 07 56907

(51) Int. Cl.

| | |
|---|---|
| ***B27J 5/00*** | (2006.01) |
| ***B29C 57/00*** | (2006.01) |
| ***B32B 15/04*** | (2006.01) |
| *H01B 3/44* | (2006.01) |

(52) U.S. Cl. ..... 264/127; 264/171.14; 264/209.1; 264/209.2; 264/211; 264/563; 425/380; 425/381; 425/467; 425/468; 174/28; 174/110 FC

(58) Field of Classification Search ..... None
See application file for complete search history.

(56) References Cited

U.S. PATENT DOCUMENTS

| | | | | |
|---|---|---|---|---|
| 3,008,187 | A * | 11/1961 | Slade | 264/119 |
| 3,464,450 | A * | 9/1969 | Steffenini | 138/113 |
| 3,771,934 | A * | 11/1973 | Delves-Broughton | 425/135 |
| 4,172,106 | A * | 10/1979 | Lewis | 264/1.28 |
| 4,225,547 | A * | 9/1980 | Okita | 264/127 |
| 5,063,018 | A * | 11/1991 | Fontirroche et al. | 264/514 |
| 5,874,032 | A * | 2/1999 | Zdrahala et al. | 264/127 |
| 5,922,155 | A * | 7/1999 | Clouet et al. | 156/51 |
| 6,780,360 | B2 * | 8/2004 | Lange et al. | 264/127 |
| 6,815,617 | B1 * | 11/2004 | Gebs et al. | 174/113 AS |
| 6,987,224 | B2 * | 1/2006 | Yamamoto et al. | 174/36 |
| 7,163,388 | B2 * | 1/2007 | Anand et al. | 425/131.1 |
| 7,214,880 | B2 * | 5/2007 | Wiekhorst et al. | 174/80 |
| 2005/0139377 | A1 | 6/2005 | Levy | |
| 2007/0098940 | A1 * | 5/2007 | Heffner | 428/36.9 |

FOREIGN PATENT DOCUMENTS

| | | |
|---|---|---|
| EP | 0 803 878 A | 10/1997 |
| EP | 1 630 829 A | 3/2006 |

* cited by examiner

*Primary Examiner* — Jeffrey Wollschlager
(74) *Attorney, Agent, or Firm* — Kenyon & Kenyon LLP

(57) ABSTRACT

An electric cable for conveying signals, the cable having a diameter of less than 2 mm and comprising at least one conductor in an insulating sheath, the sheath having a dielectric constant $\epsilon$ of less than 1.7. To achieve this, the sheath is made of PTFE and it includes at least one continuous cell. Fabrication is preferably by performing the following operations:

compressing a lubricant-impregnated PTFE powder in a converging chamber arranged in an extrusion die and around a guide for guiding said at least one conductor, the impregnated PTFE powder thus being thrust towards an extrusion orifice to form an extrudate;

causing said extrudate to pass from said orifice along an extrusion passage inside the die, in which it is shaped around the conductor(s), and of inside section that corresponds to the outline desired for the sheath;

passing said extrudate around at least one solid bar presenting, at least over a distance within the extrusion passage, the same section as said cell and thereby preventing the extrudate from occupying the section that is to be occupied by said cell, the cell(s) being formed from the downstream end surface(s) of the bar(s) and extending downstream therefrom;

extracting the lubricant by evaporation; and sintering the resulting assembly.

6 Claims, 3 Drawing Sheets

COAXIAL CABLE OF LOW DIELECTRIC CONSTANT, AND A FABRICATION METHOD AND TOOL THEREFOR

The invention relates to an electric cable of small diameter having at least one single strand or multi-strand electrical conductor in an insulating sheath, and the invention also relates to a method and to a tool for fabricating the cable. The invention also provides the coaxial cable that can be formed around such a cable, assuming it has a single conductor.

BACKGROUND OF THE INVENTION

The electric cable to which the invention applies is a cable for conveying a signal, in particular at high or very high frequency. Within a coaxial cable, it serves to convey a signal picked up by an antenna, in particular a WiFi, Bluetooth, GPRS, Mimo, 3G, etc., antenna incorporated in an electronic or computer appliance.

The specifications laid down by electronic, computer, and telecommunications industries concerning such cables are tight, thereby requiring very precise shapes and materials to be used, thus making it very difficult to fabricate cables that satisfy all of the requirements laid down.

In known manner, it is possible to make an electric cable comprising a conductor in an insulating sheath, by forming a solid sheath around the conductor, in particular forming a sheath made out of polyethylene (PE), polytetrafluoroethylene (PTFE), or indeed fluorinated ethylene propylene (FEP). These materials have the advantage of presenting a dielectric constant ($\epsilon$) that is very small.

In spite of that, when making such cables, the dielectric properties (dielectric constant $\epsilon$, dissipation factor tan $\delta$) are not satisfactory; or indeed the required level of mechanical strength is not reached. In particular, it is difficult to achieve values for the dielectric constant $\epsilon$ that are less than 2, and in particular less than 1.7.

Patent EP 0 803 878 presents an alternative solution for making such cables. That document proposes making the sheath out of a material having a low dielectric constant, such as FEP or PE.

It also provides, more particularly, for the presence of longitudinally-extending cells within the thickness of the sheath of the conductor, thus making it possible to reduce the dielectric constant of the material.

Nevertheless, that document does not describe fabricating cables using PTFE and at least one conductor in an insulating sheath. That document proposes a solution only for fabricating a conductor that is sheathed in a thermoplastic material. Unfortunately, known thermoplastic materials possess dielectric properties (dielectric constant $\epsilon$, factor tan $\delta$) that are not sufficient, given the required dielectric properties, even when the above-mentioned cells are formed in the wall of the sheath on the conductor. Furthermore, using such conductors requires special precautions to be taken when making connections by soldering, since the materials tend to melt under the effect of one or more heater elements, and that is a phenomenon that it is naturally desirable to avoid.

In addition, that document does not make provision for the possibility of the cable having a plurality of conductors.

OBJECTS AND SUMMARY OF THE INVENTION

A first object of the invention is to define an electric cable having at least one conductor in an insulating sheath presenting a dielectric constant E of less than 1.7, and possessing good mechanical strength and resistance to high temperatures.

This object is achieved by the fact that the sheath is made of PTFE and includes at least one continuous cell.

It should be observed that in the present document, the term PTFE covers pure PTFE or a material made up mostly of PTFE and possibly also including other fillers or additives.

By using PTFE, the intrinsic properties of PTFE are combined with the contribution of one or more air-filled cells, so that the resulting electric cable possesses dielectric properties that are remarkable, advantageously enabling it to be used even in a version that is of very small diameter.

Advantageously, the outside diameter of the electric cable (or the greatest distance in its section if its circumference is not circular) is less than 2 mm, or even less than 1 mm. With such an outside diameter, the cable takes up very little room and flexes easily. The dielectric performance of the sheath then makes it possible to install a plurality of cables, possibly as many as ten, in passages of very small dimensions, such as a hinge connecting a central unit to a screen in a laptop computer.

In one embodiment, the cable may be incorporated within a coaxial cable comprising a central conductor and an intermediate insulating sheath of PTFE including at least one continuous cell, within an outer conductor and an outer protective sheath, the above-defined electric cable coinciding with the central conductor taken together with the intermediate sheath.

It is also possible to envisage the outer sheath likewise being pierced by at least one continuous cell, in which case the inner sheath need not necessarily have any cells.

The invention also provides a method of sheathing at least one conductor in a PTFE sheath while forming at least one continuous cell, which method is reliable and simple to implement industrially.

This object is achieved by the fact that the method comprises the following steps:

- compressing a lubricant-impregnated PTFE powder in a converging chamber arranged in an extrusion die and around a guide for guiding said at least one conductor, the impregnated PTFE powder thus being thrust towards an extrusion orifice to form an extrudate;
- causing said extrudate to pass from said orifice along an extrusion passage inside the die, in which it is shaped around the conductor(s), and of inside section that corresponds to the outline desired for the sheath;
- passing said extrudate around at least one solid bar presenting, at least over a distance within the extrusion passage, the same section as said cell and thereby preventing the extrudate from occupying the section that is to be occupied by said cell, the cell(s) being formed from the downstream end surface(s) of the bar(s) and extending downstream therefrom;
- extracting the lubricant by evaporation; and
- sintering the resulting assembly so as to stabilize the material of the sheath.

Sintering serves to give its final properties to the material.

The method of the invention remains close to a known method of fabricating an electric cable comprising a single conductor in a PTFE sheath. That is why, with a cable having a single conductor, the method can advantageously be implemented quite easily on conventional sheathing machines.

The particular feature of the method lies specifically in the forming step that occurs within the extrusion passage. During this step, the extrudate becomes formed within the extrusion passage. It then occupies substantially the entire section that is to be occupied by the sheath: i.e. all of the space situated outside the conductor(s) and inside the extrusion passage formed in the die, while not occupying the area provided for the cell(s), which area is occupied by the bar(s) in this portion of the extrusion passage.

The bar(s) extend(s) over a certain distance inside the extrusion passage, thus causing the extrudate to take up the outside shape of the bars as it travels along said distance.

As a result, when the extrudate continues to advance beyond the downstream end surfaces of the bars, i.e. when it is no longer supported by the bars, it retains the shape imparted thereto by the bars, i.e. the shape of the cells. Air entrained with the extrudate and/or present in the already-formed downstream portion of the cell fills the empty space thus provided in the volume of the extrudate, thereby finishing off the formation of the cell(s).

Naturally, in order to enable the cells to be formed, it is necessary that some minimum quantity of air is present in the extrudate. For this purpose, an air passage is advantageously provided in the vicinity of the extrusion orifice so as to deliver the air for filling the cells.

In practice, the air passes via the orifice (or one of the orifices) for passing a conductor inside the guide. As a result the method remains simple. Since it does not require any delivery of air or fluid, nor any creation of a vacuum in the zone where the cells are formed, it can be implemented on any conventional machine for sheathing a conductor wire in a PTFE sheath.

For reasons of simplicity, the downstream end surfaces of the bars generally lie in a plane that is common to all of the bars (although this is not essential). The end faces are also preferably substantially perpendicular to the extrusion direction.

Furthermore, in an implementation of the method, the die extends downstream from said bar(s) to maintain the outer wall of the sheath over a distance downstream from the downstream end(s) of said bar(s) so as to ensure stability for the outside shape of the sheath.

It should also be observed that the method enables the forming of the sheath to begin upstream from the extrusion orifice. This applies in particular when the downstream end of the guide is upstream from the extrusion orifice, with forming of the sheath material thus beginning on coming into contact with the conductor(s) inside the converging chamber. Similarly, the cell-forming bar(s) may also begin upstream from the extrusion orifice, so as to begin forming the sheath material around the sections of the future cells.

In addition, in an implementation of the invention, for reasons of simplicity, the continuous cell(s) that are formed by the method extend in a longitudinal direction. That said, in another implementation, it is possible to turn the bars around the extrusion axis during fabrication so that the angular positions of the cells within the sheath of the conductor vary as fabrication continues. As a result, the cells are formed helically, or else they present undulations. When the bars are caused to turn during fabrication, the angular positions of the cells around the conductor vary along the length of the cable. Such varying angular positions for the cells can improve the mechanical strength of the electric cable, in particular by avoiding any particular direction of "weakness" in which the mechanical performance of the cable is lessened; this might enable the number of cells to be reduced while increasing their size, thereby further reducing the dielectric constant of the sheath.

In an implementation, the solid bar is secured to the guide. This makes it easier to make than if it were inside the die; furthermore, this avoids any material join in the outside surface of the sheath of the fabricated electric wire.

Thirdly, the invention also defines a tool for fabricating an electric cable comprising at least one conductor in a PTFE sheath that includes at least one continuous cell, said tool comprising:

- a guide having at least one inner passage suitable for passing the conductor(s) parallel to an extrusion direction;
- a die surrounding said guide;
- the guide and the die defining a converging chamber leading to an extrusion orifice; and
- the die also being extended by an extrusion passage going downstream from the extrusion orifice to shape the PTFE extrudate around the conductor(s);

which tool enables an electric cable having at least one conductor in a PTFE sheath presenting high-grade dielectric performance to be fabricated in a manner that is simple and reliable.

This object is achieved by the fact that the tool further comprises at least one solid bar for forming a cell, the bar occupying at least part of the extrusion passage and extending to a downstream end surface that is substantially perpendicular to the extrusion direction so as to form said continuous cell downstream from said downstream end surface.

It has been found that having an abrupt end for the or each bar guarantees that the corresponding cell is formed with substantially the same section as the bar.

The tool structure as defined in this way, and in particular in terms of the bar being solid, remains simple. Since the bar is solid, even when of small dimensions (e.g. a few tenths of a millimeter (mm)), the bar is strong enough to be used in fabrication. More generally, the machine used for sheathing does not have a channel for delivering or sucking air or fluid in order to form the cells, thereby avoiding any risk of such a channel becoming clogged. The air that is naturally present in contact with the extrudate, whether air in the cells or air entrained with the conductor(s) suffices to fill the cells spontaneously.

Advantageously, the bar forms an extension of the guide. Each cell is then formed starting from outside the sheath, and not from inside it. Thus, the sheath obtained by the method does not have a material connection line in the outside surface of the sheath. The PTFE is continuous and uniform at the surface of the sheath. In contrast, any non-uniformities in the structure of the material could constitute sources of problems in the long-term behavior of the resulting cable.

In an embodiment, the bar may be integral with the guide or fixed to the guide.

That said, in another embodiment, the bar may be fastened to the die. This simplifies the structure of the guide, to the detriment of the die; however it makes it easier to make the bar as a part that is fastened to the die and that is interchangeable as a function of the desired production and of the cells that are to be made.

Advantageously, the bar(s) is/are of substantially constant section. More precisely, the major portion of the or each bar, in particular away from any fastening zone, is a portion of constant section; the shape of the section corresponds to the shape of the cells in the sheath of the cable.

By moving in contact with the portion of the bar that is of constant section, the extrudate takes on the outside shape of the bar and thus the shape of the cell.

Finally, it should be observed that in the electric cable fabrication tool, the guide may be made up of a plurality of parts, in particular if the cable has a plurality of conductors. Under such circumstances, the guide may have a plurality of distinct guide elements disposed inside the die, each serving to guide a respective one of the conductors, for example.

BRIEF DESCRIPTION OF THE DRAWINGS

The invention can be well understood and its advantages appear better on reading the following detailed description of embodiments given as non-limiting examples. The description refers to the accompanying drawings, in which.

MORE DETAILED DESCRIPTION

Figure 1:
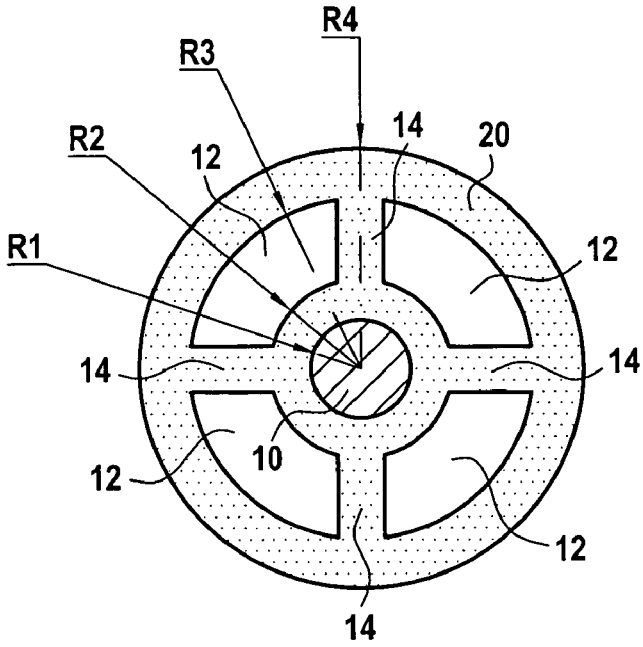
FIG. 1 is a section view perpendicular to the axis of an electric cable of the invention having a single conductor.

The structure of an electric cable of the invention is described below with reference to FIG. 1.

The electric cable shown has a single conductor 10 disposed in an insulating sheath 20 of PTFE.

The conductor 10 and the sheath 20 are substantially coaxial. The conductor 10 may be constituted by a single strand or it may be made up of a plurality of strands twisted together. In FIG. 1, the conductor 10 and the sheath 20 present an outside shape that is cylindrical and of circular section.

Naturally, other shapes of conductor and/or sheath could be used; for example, it is possible to envisage the outside section of the sheath 20 presenting an outline that is not circular, such as an oval, a rectangle, a square, etc., in particular for the purpose of making multi-conductor cables, such as cables having two or four conductors, or indeed a flat multi-strand cable.

The sheath occupies all of the volume between the outside surface of the conductor (circle of radius R1) and the outside surface of the cable (circle of radius R4), with the exception of four cells 12 that are filled with air. The sheath shown has four cells that extend longitudinally, but in general a cable of the invention could have only one cell, or two cells, or three cells, or indeed more than four cells.

The greater the number of cells and the greater the area they occupy, the greater the effect of the cells, i.e. the more the dielectric constant ($\epsilon$) of the sheath is reduced. Furthermore, this effect is also increased (i.e. the constant is decreased) by having the cells situated closer to the conductor. In the example shown, the cable has four cells. With such a small number of cells, the cells can be of large dimensions; as a result, they lower the dielectric constant of the sheath to a large extent. Furthermore, the four cells 12 are separated in pairs by four radial partitions 14 that provide mechanical strength for the sheath and in particular that provide the ability to withstand compression and to pass flexing tests. The sections of the cells are inscribed within an annulus between radii R2 and R3, where R2 and R3 both lie between R1 and R4. The compression strength comes in particular from the fact that the partitions 14 are diametrically opposite in pairs.

Some thickness of PTFE is preferably conserved all around the conductor 10, i.e. the radius R2 is greater than the radius R1 by an amount that is sufficient to enable an internal sleeve to be formed in contact with the conductor between the radii R1 and R2, serving to center the conductor 10 in the sheath 20 and preventing it from moving into one of the cells 12, while also providing sufficient adhesion between the sheath and the conductor by conserving a large contact area between the inner sleeve and the conductor 10.

Similarly, a thickness of PTFE is preferably conserved at the periphery of the sheath 20 between the radii R3 and R4, so as to form an outer sleeve that provides the outer mechanical strength of the sheath.

In the configuration that is simplest for fabrication purposes, the cells 12 extend longitudinally. By causing the cell-forming bars to turn about the extrusion axis, it is also possible to fabricate electric cables provided with PTFE sheaths having one or more cells that are helically formed, or indeed one or more cells of angular position about the conductor that varies as a function of the position of the neutral fiber of the conductor.

Figure 2A:
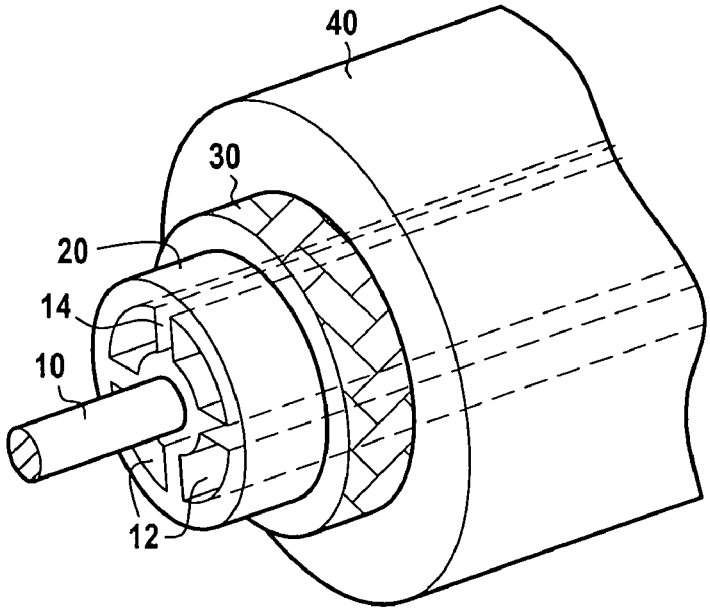
FIGS. 2A and 2B are perspective views of a coaxial cable of the invention showing two distinct embodiments, one with longitudinally-extending cells and the other with helically-formed cells.

A coaxial cable of the invention is described below with reference to FIG. 2A. The coaxial cable is obtained by incorporating the above-described electric cable inside a second conductor 30 that is placed in an outer, second insulating sheath 40.

Figure 2B:
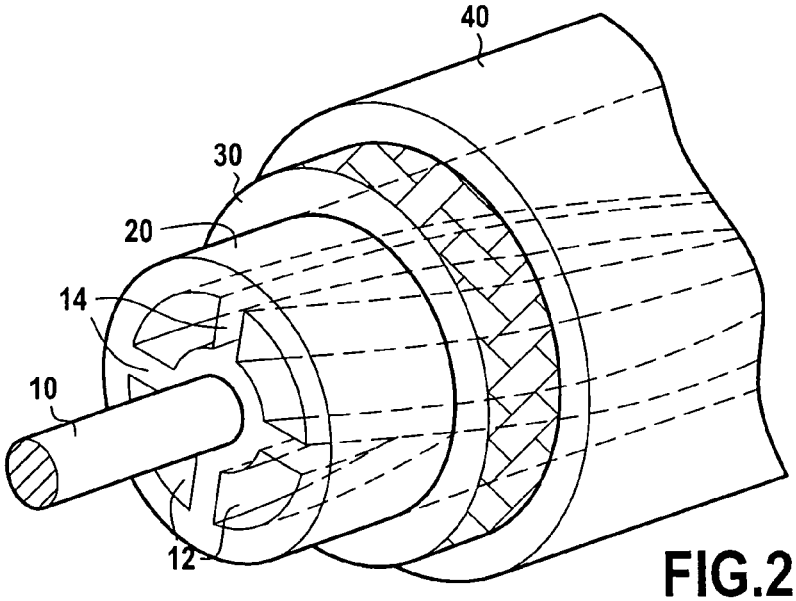

The resulting coaxial cable has a conductor wire 10 in a PTFE sheath 20. This assembly (10, 20) is covered by a second conductor 30 that is in the form of a braid, and that is itself covered by a protective insulating sheath 40. The coaxial cable as shown has four continuous cells 12. In FIG. 2A, these cells 12 are longitudinally-extending cells, this being the preferred embodiment. FIG. 2B shows a cable similar to that of FIG. 2A, however instead of having its continuous cells 12 extending longitudinally, they are formed helically.

Figure 4:
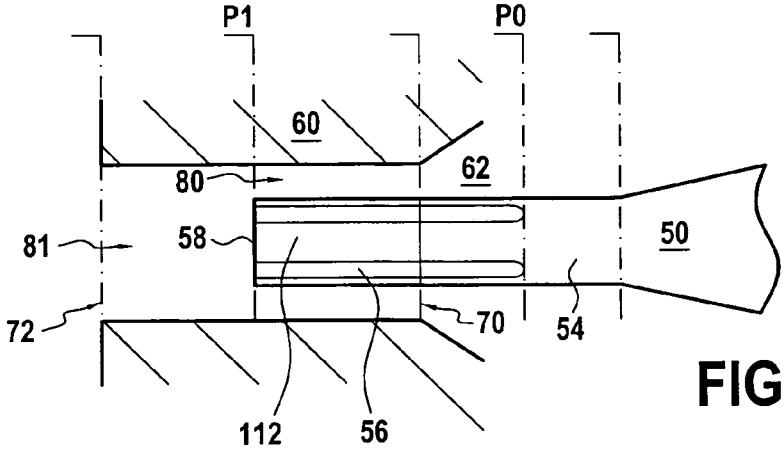
FIG. 4 is an axial section view of the FIG. 3 tool showing its end that is axially downstream in the extrusion direction.
Figure 3:
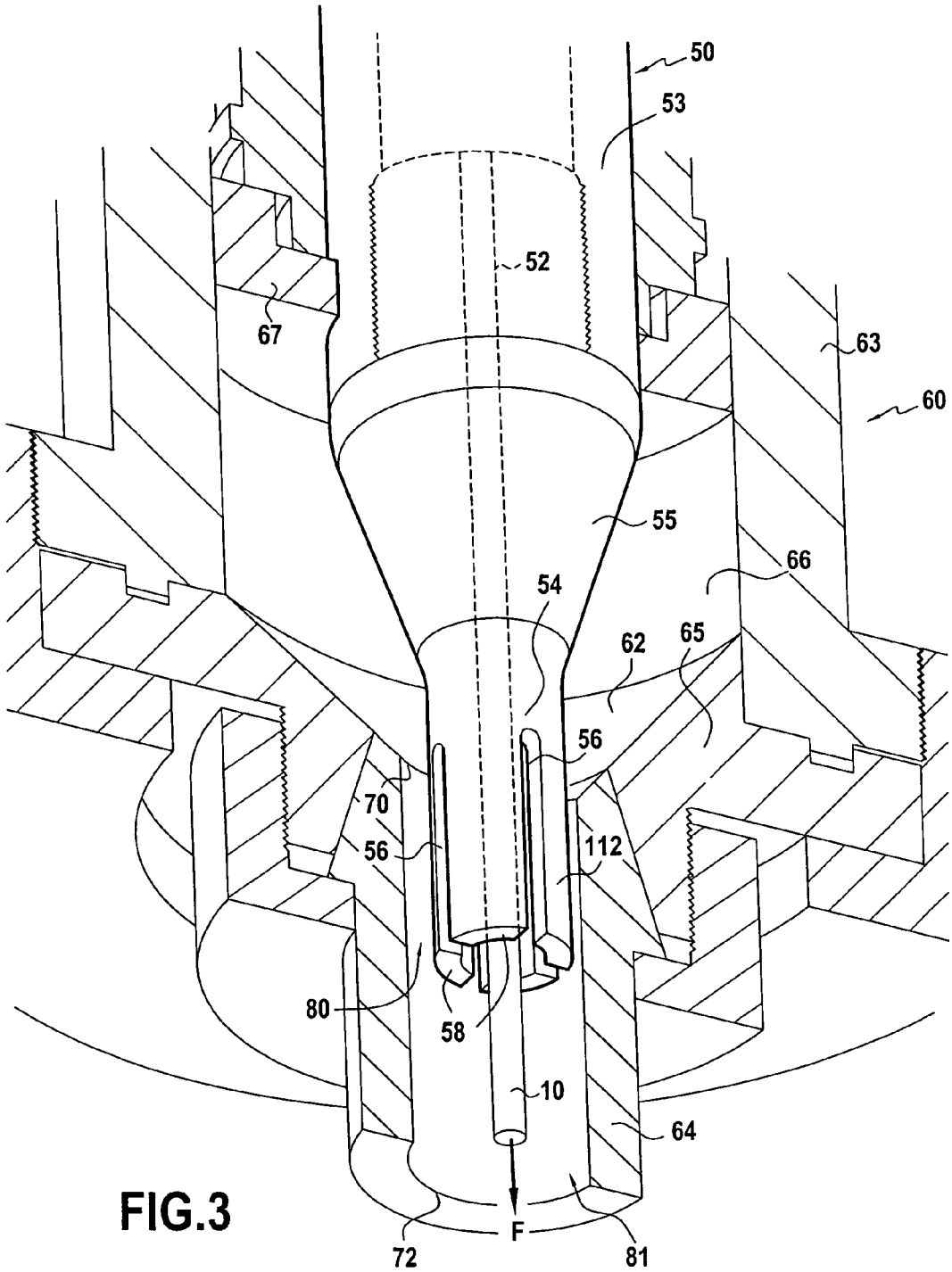
FIG. 3 is a perspective view of a tool of the invention for fabricating a conductor in a PTFE sheath.

A tool of the invention for fabricating a cable is described below with reference to FIGS. 3 and 4.

The tool is used for fabricating an electric cable comprising a conductor in a PTFE sheath that is extruded in an extrusion direction represented by arrow F.

The tool has a guide 50 for guiding the conductor(s), which guide presents an inner channel 52 through which the conductor(s) passes. In the embodiment shown, this inner channel 52 has a cylindrical downstream portion of inside diameter that is equal to the outside diameter of the conductor 10, plus a small amount of clearance (not shown) so as to allow the conductor 10 to pass. The guide 50 serves in particular to guide and position the conductor (single conductor in the example shown), in the downstream portion of the tool, where the sheathing operation is to take place.

The guide 50 has three portions 53, 55, 54 that are in the form of bodies of revolution about the extrusion axis. The upstream portion 53 has a cylindrical outside shape. The central portion 55 has a conical outside shape, with the small end of the cone pointing in the downstream direction. The downstream portion 54 is tubular in shape.

The tool also has a die 60 surrounding the guide 50.

Like the tool 50, the die 60 presents three portions, an upstream portion 63 presenting a cylindrical internal opening that is followed in the downstream direction by a central portion 65 presenting a conical opening and that is extended downstream by a downstream portion 64.

The die 60 and the guide 50 can each comprise one or more parts.

Figure 5:
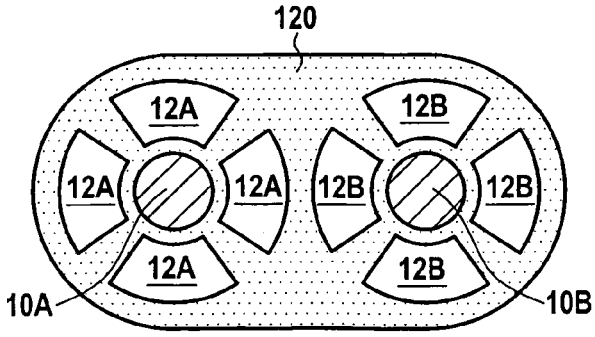
FIG. 5 is a section view perpendicular to the axis of an electric cable of the invention that includes two conductors.

In the tool shown, the die 60 and the guide 50 are coaxial, since they are both formed around the same axis referred to as the extrusion axis. When the electric cable is designed to have a plurality of conductors, then the guide 50 is not coaxial with the die 60 in the sense that its axis (or axes) is/are parallel to the axis of the die; however the guide 50 need not be concentric about the die 60. (FIG. 5 shows an example of a cable having a plurality of conductors.)

Between the upstream portions 53, 63 of the guide 50 and of the die 60, there extends a cylindrical chamber 66. In this chamber, a piston 67 that is slidably movable around the guide 50 serves to compress the PTFE (not shown) so as to thrust it into the converging chamber 62 that is formed between the central portions 55 and 65 of the guide 50 and of the die 60, compressing the PTFE in the extrusion direction.

The chamber 62 is in the form of a converging portion extending substantially between the two respective conical portions 55 and 65 of the guide 50 and of the die 60 so as to enable the PTFE to be expelled, or more precisely to be extruded, through the extrusion orifice 70 under the effect of the applied pressure.

Downstream from the extrusion orifice 70, the converging chamber 62 is extended by the extrusion passage 80.

The tubular portion 54 of the guide is situated in part or completely inside the converging chamber 62. The downstream end of this portion 54 can thus be found either inside the converging chamber 62, or inside the extrusion passage 80. It is preferable for it to extend at least as far as the vicinity of the extrusion passage 80 so as to enable the guide 50 to ensure that the conductors are properly positioned relative to the sheath, in particular in the extrusion passage.

The extrusion passage 80 is a cylindrical passage extending in the extrusion direction inside the downstream portion 64 of the die 60 as far as an outlet orifice 72. The shape (in section) of this passage is the shape desired for the outline of the cable. The passage 80 is thus cylindrical in shape with a circular section of radius R4 in the example shown.

Furthermore, the tool has one or more cell-forming bars 112 for forming the cells. In the example, shown the tool thus has four bars 112 of substantially constant section that extend in the converging chamber 62 and the extrusion passage 80. One bar 112 is provided per cell so as to form the cells that are provided in the sheath. These bars 112 extend in the extrusion direction from a plane P0 to a plane P1.

The upstream plane P0 of the bars is preferably upstream from the extrusion orifice 70 so as to enable the inner sleeve to be formed in contact with the conductor in the converging chamber 62 where the pressure is slightly lower than in the extrusion passage 70. Nevertheless, it is also possible for the plane P0 to be located level with the extrusion orifice 70.

In the tool shown, the bars 112 are fastened to the downstream end of the tubular portion 54 of the guide 50 in the plane P0. The bars 112 are thus advantageously secured to the guide and enable the cells to be formed inside the sheath. Because of this, the inside surface of the die remains free and is not used for supporting the bars 112, thus making it possible to form the outside surface of the sheath in continuous manner. As a result, with the tool shown, the sheath does not have any material join zones in its outside surface.

Furthermore, the positions of the bars 112 extending the guide 50 advantageously enable them to provide continued guidance for the conductors between the planes P0 and P1, where such guidance is provided upstream from the plane P0 by the guide 50.

In the embodiment shown, the various bars 112 come to an end in a common plane P1, however this configuration is not essential.

Various possibilities can be envisaged concerning the position of the plane P1 (or of the various planes P1 where different bars come to respective downstream ends) relative to the outlet orifice 72 of the die. Any of the possibilities can be used.

Preferably, and as shown in the figures, the plane P1 is upstream from the outlet orifice 72 of the die 60. The extrusion passage 80 then has a guide portion 81 extending from the plane P1 as far as the orifice 72. This guide portion 81 serves to guide and form the sheath, and to stabilize its shape.

Conversely, it is possible for the plane P1 to coincide with or to be located downstream from the outlet orifice 72. Under such circumstances, the guide passage 81 does not exist and the bars extend beyond the outlet orifice 72 of the die.

The principle of extrusion in such a tool is as follows.

The guide 50 brings the conductor 10 to the center of the extrusion die and holds it there.

Upstream, in the cylindrical chamber 66, PTFE is thrust by the piston 67 and compressed into the chamber 62. Its pressure increases as its advances in the converging portion of the chamber 62, thereby causing the PTFE to fibrillate upstream from the extrusion orifice 70 and causing the resulting extrudate to be expelled into the extrusion passage 80.

The downstream tubular portion 54 of the guide 50 extends into the converging chamber 62 from its upstream end and close to the extrusion orifice 70. Around this portion 54 of the guide 50, the extrudate adopts the cylindrical outside shape of the tubular portion. It thus takes on a shape that prefigures the outer sleeve of the PTFE sheath between the radii R3 and R4.

The extrudate then reaches and goes beyond the downstream end of the die 50 at the plane P0. On passing between the bars 112 via slots 56, it then comes into contact with the conductor so as to form the inner sleeve around and in contact with the conductor 10, between the radii R1 and R2.

Thus, in the plane P0, the tubular portion 54 of the guide comes to an end and is replaced by the four cell-forming bars 112. The sections of these bars correspond to the four sections that are to be presented by the cells.

These bars extend in the continuation of the guide 50 downstream from the plane P0 at the end of the guide 50 and as far as the plane P1 where each of them comes to a sudden end with a downstream end surface 58 that is substantially perpendicular to the extrusion direction.

In section, the bars are in the form of angular sectors between the radii R2 and R3.

The section shape of the bars 112 is thus inscribed in an annulus, passages (the slots 56) being formed between the bars in order to allow the extrudate to pass from the outside of the annulus towards the inside thereof in contact with the conductor(s) 10.

Thus, as from the plane P0, the extrudate occupies not only the outer periphery of the section provided for the sheath 20, but it also passes via the slots 56 to invade the entire annular space surrounding the conductor 10. Thus, between the plane P0 and P1 it occupies the entire section that is to be occupied by the sheath 20, while the bars 112 keep empty the four sections that are to be occupied by the cells 12.

It can thus be understood that during formation of the sheath 20, the outer sleeve, the inner sleeve, and the cells are all formed essentially simultaneously, the tubular portion 54 of the guide 50 serving to begin formation of the outer sleeve (radius R3) whose outline (radius R4) is set as from the extrusion orifice 70, and the plane P0 marks the beginning of the formation of the inner sleeve and of the cells.

Preferably, the shape of the bars 112 in the extrusion direction is inscribed in the volume of the wall of a tube. Advantageously, the downstream portion 54 of the guide and the bars 112 can then be made from a single tube.

It should be observed that other embodiments are possible; specifically, instead of being a tube of circular section, the downstream end 54 of the guide 50 could present any other section, including channels suitable for passing the conductor (s) and presenting bars that extend over a distance in the extrusion direction to form the cells.

In the example shown, the bars 112 are made by machining for the four slots 56 in a tube between the planes P0 and P1. These slots 56 are diametrically opposite in pairs. In other words, the passages (the slots 56) formed between two bars 112 are diametrically opposite. It is therefore easy to make these slots 56 or passages by sawing or by electroerosion applied to a piece of tube that is used for making the tubular portion 54. The tool as described in this way is therefore relatively inexpensive to fabricate and has few parts, since the bars 112 are formed integrally with the guide 50.

Furthermore, in the extrusion passage 80, the extrudate coming into contact with the inside wall of the die 60 adopts for its outer periphery the shape intended for the outer sheath of the cable.

Continuing downstream (in conventional manner at the same speed as the conductors), the extrudate reaches the downstream end plane P1 of the bars 112. The terminations of the bars lead immediately to cells being formed as from the plane P1. The volume previously occupied by each bar is immediately occupied by air that fills the cell taking the place of the bar. The bar thus acts as a core, of a shape suitable for forming the cell 12. The rigidity of the extrudate at the plane P1 ensures that the cell 12 does not collapse.

Finally, in order to guarantee that the shape of the sheath 20 is stable, the guide 60 continues as far as the outlet orifice 72 beyond the plane P1. The extrusion passage thus has a guide portion 81 that enables the outside of the cable to be guided over the distance from the plane P1 to the orifice 72 so as to ensure that the outside shape of the sheath is fully stabilized.

As mentioned above, the electric cable is then subjected to evaporation of the lubricant, and then to a final sintering operation that gives it its final properties.

Furthermore, the entire area occupied by the bars 112 (as measured in section) preferably remains less than the area of the guide 50, and is less than 50% of the total area of the section of the sheath.

Finally, it should be observed that the size of the tool of the invention can be very small. In particular, the tool can be made to have an extrusion passage with a diameter corresponding to the diameter of the resulting cable that is less than 1.5 mm or 2 mm, or in quite remarkable manner, to have a diameter that is less than 1 mm, or even less than 0.4 mm. The size of the cells 12 can then be very small and can be less than 0.5 mm or even 0.3 mm in a radial direction (R3-R2).

FIG. 5 shows an electric cable of the invention. In this embodiment, the cable has two conductors 10A and 10B.

It presents a sheath 120 having eight cells, four cells 12A around the conductor 10A and four other cells 12B around the conductor 10B. The conductors and the cells extend in the longitudinal direction of the electric cable, i.e. perpendicularly to the plane of the figure.

The invention can thus be generalized and implemented in cables presenting a very wide variety of numbers and arrangements of conductors and cells. The effectiveness of the insulation of the sheath made in this way increases as a general rule with the number and the area of the cells surrounding a conductor, i.e. with increasing ratio of air to PTFE in the immediate vicinity of the conductor.

What is claimed is:

1. A method of sheathing at least one conductor in a PTFE sheath having at least one continuous cell, said method comprising the following steps:

compressing a lubricant-impregnated PTFE powder in a converging chamber arranged in an extrusion die and around a guide for guiding said at least one conductor, the impregnated PTFE powder thus being thrust towards an extrusion orifice to form an extrudate;

causing said extrudate to pass from said orifice along an extrusion passage inside the die, in which it is shaped around a downstream tube-shaped portion of said guide;

passing said extrudate around at least two solid bars presenting, at least over a distance within the extrusion passage, the same section as said at least one continuous cell and thereby preventing the extrudate from occupying the section that is to be occupied by said at least one continuous cell, the at least one continuous cell being formed from the downstream end surface of the at least two solid bars and extending downstream therefrom;

extracting the lubricant by evaporation; and sintering the resulting assembly so as to stabilize the material of the sheath, wherein the at least two solid bars each have a substantially constant section inscribed in an annulus and forming an angular sector whose outer radius is equal to the outer radius of the downstream tube-shaped portion, and wherein a passage forming a through hole between the at least two solid bars enables the extrudate to pass from the outside of the annulus to the inside thereof in contact with the at least one conductor.

2. A method according to claim 1 for sheathing at least one conductor, in which the at least two solid bars are secured to the guide.

3. A method according to claim 1 for sheathing at least one conductor, in which a passage for air is provided in the vicinity of the extrusion orifice to deliver air for filling the cells.

4. A method according to claim 3 for sheathing at least one conductor, in which said passage for air is made via an orifice for passing the conductor.

5. A method according to claim 1 for sheathing at least one conductor, in which the die extends downstream from said at least two solid bars to maintain the outer wall of the sheath over a distance downstream from the downstream end of at least one of said at least two solid bars so as to ensure stability for the outside shape of the sheath.

6. A method according to claim 1 for sheathing at least one conductor, in which, during fabrication, the at least two solid bars are caused to turn about the extrusion axis so that the angular positions of the cells within the sheath of the at least one conductor vary during fabrication.

* * * * *